US010344759B2

(12) United States Patent
Yamamoto et al.

(10) Patent No.: US 10,344,759 B2
(45) Date of Patent: Jul. 9, 2019

(54) VARIABLE DISPLACEMENT OIL PUMP

(71) Applicants: TOYOTA JIDOSHA KABUSHIKI KAISHA, Toyota-shi, Aichi-ken (JP); AISIN SEIKI KABUSHIKI KAISHA, Kariya-shi, Aichi-ken (JP)

(72) Inventors: Michitaka Yamamoto, Okazaki (JP); Hisashi Ono, Okazaki (JP); Yuki Nishida, Anjo (JP)

(73) Assignees: TOYOTA JIDOSHA KABUSHIKI KAISHA, Toyota (JP); AISIN SEIKI KABUSHIKI KAISHA, Kariya-shi (JP)

( * ) Notice: Subject to any disclaimer, the term of this patent is extended or adjusted under 35 U.S.C. 154(b) by 69 days.

(21) Appl. No.: 15/430,741

(22) Filed: Feb. 13, 2017

(65) Prior Publication Data

US 2017/0241416 A1 Aug. 24, 2017

(30) Foreign Application Priority Data

Feb. 19, 2016 (JP) ..... 2016-030338

(51) Int. Cl.

| | |
|---|---|
| ***F03C 2/00*** | (2006.01) |
| ***F03C 4/00*** | (2006.01) |
| ***F04C 14/18*** | (2006.01) |
| ***F04C 2/10*** | (2006.01) |
| ***F04C 14/22*** | (2006.01) |

(52) U.S. Cl.

CPC ..... *F04C 14/18* (2013.01); *F04C 2/10* (2013.01); *F04C 2/102* (2013.01); *F04C 14/223* (2013.01); *F04C 2210/206* (2013.01); *F04C 2240/10* (2013.01); *F04C 2240/30* (2013.01)

(58) Field of Classification Search

CPC .. F04C 2/10; F04C 2/102; F04C 14/18; F04C 14/223; F04C 2210/206; F04C 2240/30; F04C 2240/10

USPC ..... 418/19, 22, 24, 166, 171

See application file for complete search history.

(56) References Cited

U.S. PATENT DOCUMENTS

| | | | | |
|---|---|---|---|---|
| 2014/0023539 | A1* | 1/2014 | Izutsu | F04C 14/22 418/19 |
| 2015/0285246 | A1* | 10/2015 | Tsuge | F04C 14/22 418/19 |
| 2015/0354564 | A1* | 12/2015 | Takahashi | F04C 14/22 418/19 |

FOREIGN PATENT DOCUMENTS

| | | | |
|---|---|---|---|
| CN | 104718378 | A | 6/2015 |
| JP | S59-112380 | U | 7/1984 |
| JP | S62-063880 | U | 4/1987 |
| JP | 2005-285310 | A | 10/2005 |

(Continued)

OTHER PUBLICATIONS

Partial Translation of Apr. 3, 2018 Office Action Issued in Japanese Patent Application No. 2016-030338.

(Continued)

*Primary Examiner* — Theresa Trieu
(74) *Attorney, Agent, or Firm* — Oliff PLC

(57) ABSTRACT

A variable displacement oil pump includes an adjustable member that is configured to shift according to changes in pressure inside a control oil chamber. The adjustable member has a long hole. A guide pin is disposed inside the long hole. The guide pin is fixed to either a housing or a cover of the variable displacement oil pump. The width of the long hole is larger at a part of the long hole farther away from a fixed end of the guide pin in its lengthwise direction than at a part thereof closer to the fixed end.

5 Claims, 4 Drawing Sheets

(56) References Cited

FOREIGN PATENT DOCUMENTS

| | | | | | |
|---|---|---|---|---|---|
| JP | 2014139420 | A | * | 7/2014 | ..... F04C 2/086 |
| JP | 2015-140670 | A | | 8/2015 | |

OTHER PUBLICATIONS

U.S. Appl. No. 15/756,227, filed Feb. 28, 2018.
U.S. Appl. No. 15/756,161, filed Feb. 28, 2018.

* cited by examiner

VARIABLE DISPLACEMENT OIL PUMP

INCORPORATION BY REFERENCE

The disclosure of Japanese Patent Application No. 2016-030338 filed on Feb. 19, 2016 including the specification, drawings and abstract is incorporated herein by reference in its entirety.

BACKGROUND

1. Technical Field

The present disclosure relates to a variable displacement oil pump that can change the amount of oil discharged from its discharge port.

2. Description of Related Art

One example of variable displacement oil pumps is described in Japanese Patent Application Publication No. 2015-140670. This variable displacement oil pump has an adjustable member arranged in a housing space defined by a housing and a cover member, and can change the amount of oil discharged from its discharge port by shifting the adjustable member. A control oil chamber to which oil is supplied from an oil control valve is defined and formed by the adjustable member inside the housing space of the variable displacement oil pump. An urging member that applies an urging force to the adjustable member in a direction of reducing the volume of the control oil chamber is further provided inside the housing space.

The adjustable member of the above variable displacement oil pump is provided with long holes that regulate the shift direction of the adjustable member, and guide pins are inserted in these long holes. When the pressure inside the control oil chamber is changed through operation of the oil control valve, the adjustable member shifts in an extension direction of the long holes. As a result, the positional relation between the adjustable member and the discharge port changes, so that the amount of oil discharged from the discharge port changes.

In some cases, one end of the guide pin is a fixed end that is press-fitted into a first hole provided in the housing, while the other end of the guide pin is a free end that is loosely fitted into a second hole provided in the cover member. In such cases, the cover member is installed on the housing with the guide pin fixed to the housing. Thus, compared with when the other end of the guide pin is press-fitted into the second hole of the cover member, the other end of the guide pin is easy to insert into the second hole and the ease of installation can be enhanced accordingly.

SUMMARY

If a variable displacement oil pump such as described above is disposed near a heat source of an internal combustion engine etc., the guide pin may thermally deform as the variable displacement oil pump receives heat generated by the heat source and heat of oil suctioned through a suction port. Since the guide pin is fixed to the housing, the guide pin receives heat from the housing. In the course of thus receiving heat repeatedly, the guide pin deforms gradually at a root part that protrudes from the housing toward the cover member, eventually inclining so that the fixed end and the free end of the guide pin are misaligned in a direction orthogonal to a lengthwise direction of the guide pin before thermal deformation. While the inclination direction of the guide pin varies from piece to piece, when the direction orthogonal to bath the lengthwise direction of the guide pin before thermal deformation and the extension direction of the long hole is defined as the specified direction and those surfaces of wall surfaces of the long hole of the adjustable member that are located on both sides across the guide pin in the specified direction are defined as guide surfaces, it is also possible that the guide pin inclines so as to approach the guide surface. When the degree of inclination of the guide pin thus increases, the guide pin comes in contact with the guide surface of the long hole, causing the adjustable member to be displaced in a direction different from the extension direction of the long hole. This ends up with the adjustable member being pushed by the inclined guide pin toward one side in the specified direction. Then, clearances provided between components of the variable displacement oil pump including the adjustable member to allow smooth motion of these components are narrowed or eliminated, which may make it difficult for the adjustable member to shift in the extension direction of the long hole. In that case, the adjustable member shifts only in a small amount in response to changes in pressure inside the control oil chamber, and thus the controllability of the amount of oil discharged from the discharge port degrades.

The present disclosure provides a variable displacement oil pump that can prevent degradation of the controllability of the oil discharge amount.

An aspect of the present disclosure is a variable displacement oil pump that includes a housing, a cover, an adjustable member, and a guide pin. The housing and the cover define a housing space. The adjustable member has a long hole. The adjustable member defines a control oil chamber inside the housing space. The adjustable member is configured to shift inside the housing space. The guide pin is fixed to either one of the housing and the cover. The guide pin is disposed inside the long hole. The adjustable member is configured to shift in an extension direction of the long hole according to changes in pressure inside the control oil chamber such that an amount of oil discharged from a discharge port changes. A width of the long hole at a part of the long hole farther away from a fixed end of the guide pin, in a lengthwise direction of the guide pin, is larger than the width at a part of the long hole closer to the fixed end. The width of the long hole is defined by the dimension of the long hole in a specified direction. The specified direction is a direction orthogonal to both the lengthwise direction of the guide pin and the extension direction of the long hole.

When the variable displacement oil pump receives heat from the outside of the variable displacement oil pump, the guide pin receives heat from one of the housing and the cover to which the guide pin is fixed. This may result in an inclination of the guide pin as the guide pin thermally deforms at a root part that protrudes toward the other one of the housing and the cover to which the guide pin is not fixed. In this case, when the guide pin inclines so that the fixed end and the free end are misaligned in the specified direction, i.e., when the guide pin inclines in the specified direction, the guide pin approaches the guide surface of the long hole of the adjustable member.

According to the above configuration, the width of the long hole is larger at a part of the long hole farther away from the fixed end of the guide pin in the lengthwise direction of the guide pin than at a part thereof closer to the fixed end. Thus, even when the guide pin inclines in the specified direction and approaches the guide surface of the long hole as described above, the guide pin is prevented from coming in contact with the guide surface (i.e., the adjustable member). In other words, the adjustable member is prevented from being pushed by the guide pin inclined in the specified direction, and the clearances provided between the components of the variable displacement oil pump including the adjustable member are prevented from being narrowed or eliminated. As a result, the adjustable member has no difficulty in shifting in the extension direction of the long hole, and thus degradation of the controllability of the oil discharge amount can he prevented.

In the above variable displacement oil pump, the guide pin may be fixed to a first member. The first member may be one of the housing and the cover. The other one of the housing and the cover that is not the first member may he a second member. The second member may have a housing hole in which a free end of the guide pin is housed. The width of the long hole at the end of the long hole (711) on the housing hole side may be larger than a width of the housing hole. The width of the housing hole may be a dimension of the housing hole in the specified direction.

When the second member is thus provided with the housing hole and the free end of the second member is housed in the housing hole, even when the guide pin inclines in the specified direction as described above, the free end of the guide pin comes in contact with the outermost end of a wall surface of the housing hole in the specified direction, so that the free end of the guide pin shifts only within the housing hole in the specified direction. Moreover, the amount of shift in the specified direction of the part of the guide pin located inside the long hole is smaller than the amount of shift in the specified direction of the free end of the guide pin. In the above configuration, therefore, the width of the long hole at the end on the housing hole side is set to be larger than the width of the housing hole. Accordingly, when the free end of the guide pin comes in contact with the outermost end of the wall surface of the housing hole in the specified direction, further inclination of the guide pin in the specified direction is prevented, so that contact between the guide pin and the guide surface of the long hole is prevented. Thus, it is possible to prevent the adjustable member from being displaced in a direction different from the extension direction of the long hole as the guide pin comes in contact with the guide surface.

In the above variable displacement oil pump, the width of the long hole may increase gradually as the long hole extends further away from the fixed end of the guide pin in the lengthwise direction of the guide pin. When the width of the long hole is increased stepwise, steps are formed on the guide surface of the long hole. Then, when the inclined guide pin comes in contact with such a step on the guide surface, local wear occurs in a portion of the guide pin in contact with the guide surface due to a high surface pressure the guide pin receives. In the above configuration, therefore, the width of the long hole increases gradually as the long hole extends farther away from the fixed end of the guide pin in the lengthwise direction of the guide pin, so that no steps are formed on the guide surface of the long hole. Thus, local wear of the guide pin can be prevented.

The guide pin inclines sometimes toward one side in the specified direction and other times toward the other side in the specified direction. In the above variable displacement oil pump, surfaces of wall surfaces of the long hole of the adjustable member that are located on both sides across the guide pin in the specified direction may be guide surfaces. The guide surfaces of the long hole may be each shaped so as to be separated farther away from the guide pin in the specified direction at a part of the guide surface farther away from the fixed end of the guide pin in the lengthwise direction of the guide pin than at a part of the guide pin closer to the fixed end. According to this configuration, to whichever side in the specified direction the guide pin may incline, contact between the guide pin and the guide surface of the long hole can be prevented.

It is not preferable to form steps on the guide surface in this case, too, where the guide surfaces are each shaped so as to be separated farther away from the guide pin at a part of the guide surface farther away from the fixed end of the guide pin than at a part thereof closer to the fixed end. In the above variable displacement oil pump, the guide surfaces of the long hole may be each shaped so as to be separated farther away from the guide pin in the specified direction as the guide surface extends farther away from the fixed end of the guide pin in the lengthwise direction of the guide pin. According to this configuration, no steps are formed on the guide surface, so that local wear of the guide pin can be prevented.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
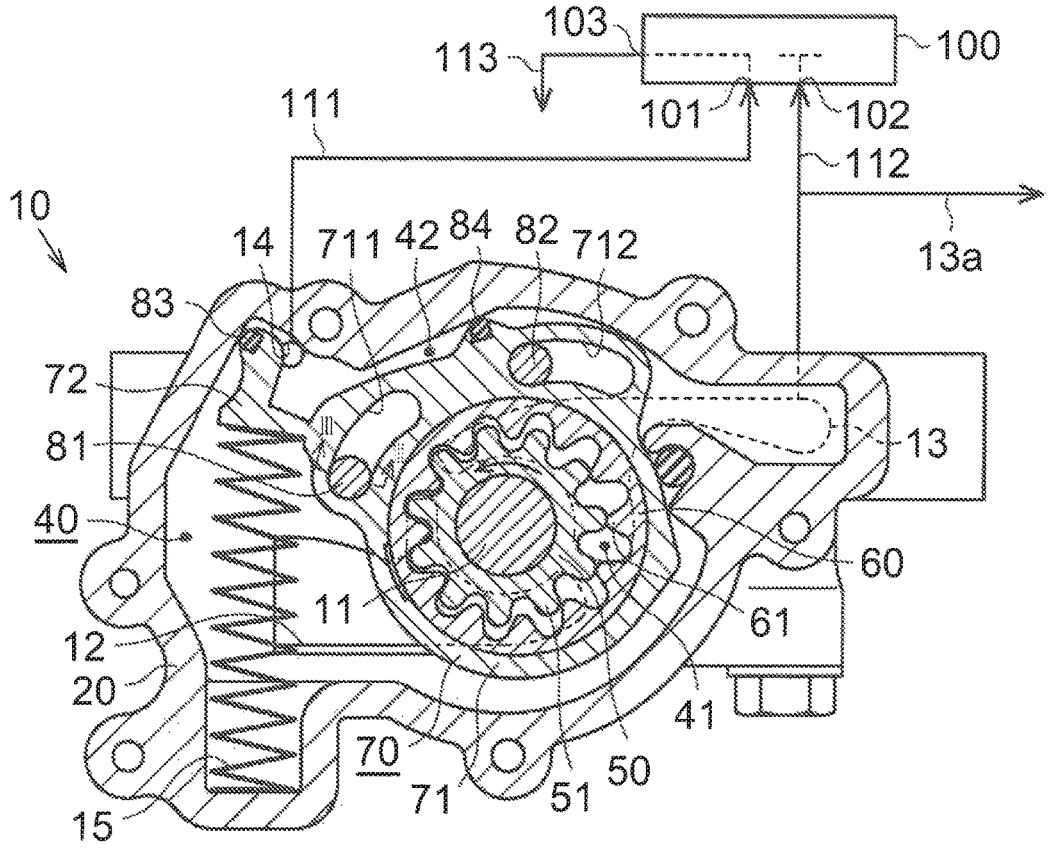
FIG. 1 is a sectional view showing the position of an adjusting ring when an oil discharge amount is maximum in one embodiment of a variable displacement oil pump.
Figure 2:
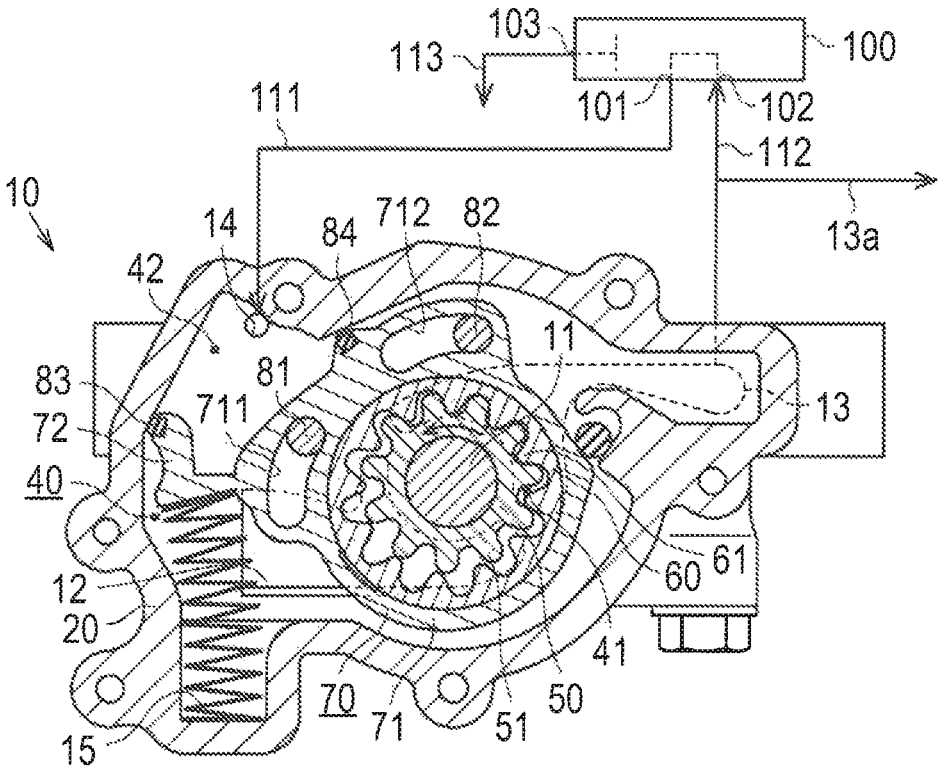
FIG. 2 is a sectional view showing the position of the adjusting ring when the oil discharge amount is minimum in the variable displacement oil pump of the embodiment.
Figure 3:
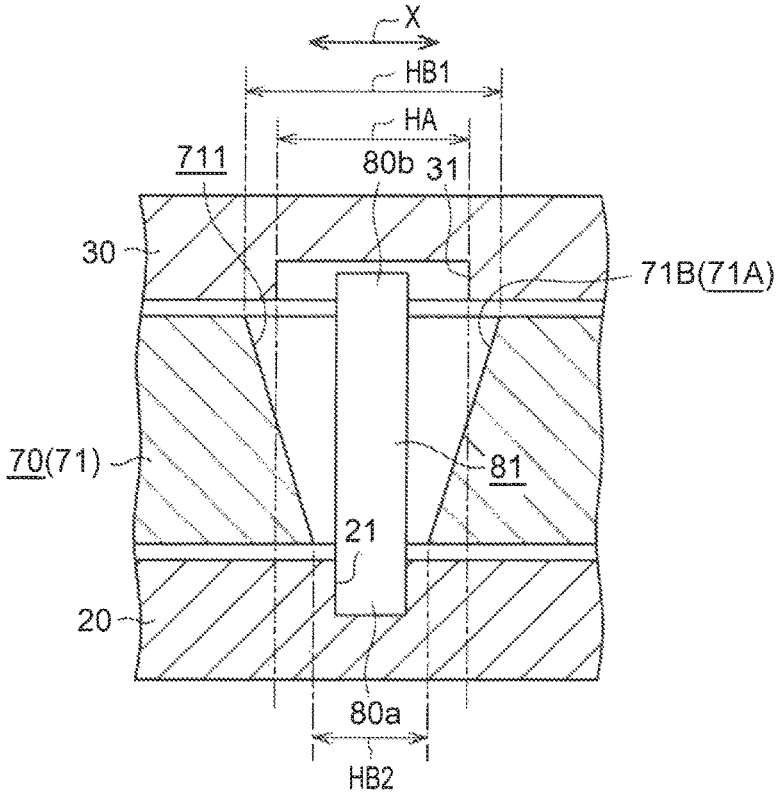
FIG. 3 is a sectional view taken along the arrow line of FIG. 1.

One embodiment of a variable displacement oil pump will be described below in accordance with FIG. 1 to FIG. 4. A variable displacement oil pump 10 of this embodiment shown in FIG. 1 and FIG. 2 is a pump that is mounted in an internal combustion engine and operates on the basis of rotation of a crankshaft of the internal combustion engine. As shown in FIG. 1 and FIG. 2, the variable displacement oil pump 10 includes a housing 20, a cover member 30 (see FIG. 3) installed on the housing 20, and an input shaft 11 that rotates in synchronization with the crankshaft. As FIG. 1 and FIG. 2 show the internal structure of the variable displacement oil pump 10, the cover member 30 is not shown in these drawings. The positional relation between the cover member 30 and the housing 20 is shown in FIG. 3 that is a sectional view taken along the line III-III of FIG. 1.

An inner rotor 50, an outer rotor 60 and an adjusting ring 70 are provided inside a housing space 40 defined by the housing 20 and the cover member 30. The inner rotor 50 is mounted on the input shaft 11 and rotates integrally with the input shaft 11. The outer rotor 60 is disposed further on the outer circumferential side than the inner rotor 50. The adjusting ring 70 surrounding the outer rotor 60 is in an annular shape. The inner rotor 50, the outer rotor 60, and the adjusting ring 70 are sintered members made by packing metal solid powder, such as iron powder, into a mold and sintering the powder.

The inner rotor 50 is provided with a plurality of external teeth 51 on the outer circumference of the inner rotor 50. The outer rotor 60 is provided with a plurality of internal teeth 61 on the inner circumference of the outer rotor 60. The plurality of internal teeth 61 is configured to mesh with the external teeth 51 of the inner rotor 50. The number of the internal teeth 61 is larger by one than the number of the external teeth 51. The outer rotor 60 is rotatably held by the adjusting ring 70.

The center of rotation of the outer rotor 60 is eccentric relative to the center of rotation of the inner rotor 50. The external teeth 51 of the inner rotor 50 and the internal teeth 61 of the outer rotor 60 are partially in mesh with each other (in a part on the left side in FIG. 1). The outer circumference of the inner rotor 50 and the inner circumference of the outer rotor 60 define a working chamber 41 to be filled with oil.

In a part of the working chamber 41 from a position at which the external teeth 51 of the inner rotor 50 and the internal teeth 61 of the outer rotor 60 mesh with each other to a predetermined position in the rotation direction of the input shaft 11 indicated by the arrow in FIG. 1, the clearance between the external teeth 51 of the inner rotor 50 and the internal teeth 61 of the outer rotor 60 increases gradually as the rotors 50, 60 rotate. A suction port 12 is open in that part where the clearance between the external teeth 51 of the inner rotor 50 and the internal teeth 61 of the outer rotor 60 increases gradually. The suction port 12 communicates with an oil path leading to an oil pan via an oil strainer.

On the other hand, a discharge port 13 is open in a part of the working chamber 41 in which the clearance between the external teeth 51 of the inner rotor 50 and the internal teeth 61 of the outer rotor 60 decreases gradually as the rotors 50, 60 rotate. The discharge port 13 communicates with an oil discharge path 13*a* leading to a main gallery of an oil supply system.

When the variable displacement oil pump 10 operates, the rotors 50, 60 rotate in mesh with each other as the input shaft 11 rotates. Then, oil stored in the oil pan is suctioned from the suction port 12 into the working chamber 41 via the oil strainer, and is discharged from the discharge port 13 to the oil discharge path 13*a*. Thus discharged to the oil discharge path 13*a*, the oil flows through the oil discharge path 13*a* and is supplied to the main gallery of the oil supply system, and from the main gallery to a crank journal or a cam journal.

As shown in FIG. 1 and FIG. 2, the adjusting ring 70 includes an annular main body part 71 that holds the outer rotor 60, and a protruding part 72 that protrudes from the outer circumference of the main body part 71 in the radial direction of the rotors 50, 60. The main body part 71 has long holes 711, 712 that extend in the rotation direction of the rotors 50, 60. Guide pins 81, 82 fixed to the housing 20 are inserted in the long holes 711, 712. Accordingly, the adjusting ring 70 can shift in the extension direction of the long holes 711, 712 while being restricted by the guide pins 81, 82 from shifting in a direction different from the extension direction of the long holes 711, 712. Thus, the adjusting ring 70 in this embodiment is one example of the adjustable member that shifts inside the housing space 40.

A first seal member 83 is provided at the leading end of the protruding part 72, and a second seal member 84 is provided at a portion of the outer circumference of the main body part 71 between the two long holes 711, 712. The seal members 83, 84 come in contact with a side wall of the housing 20 and thereby seal the space between the side wall and the outer circumference of the adjusting ring 70, so that a control oil chamber 42 is defined and formed inside the housing space 40. The adjusting ring 70 is shifted in the extension direction of the long holes 711, 712 in a state where the seal members 83, 84 and the side wail of the housing 20 are kept in sliding contact with each other.

The control oil chamber 42 is provided with an opening 14 communicating with a control oil path 111, and oil can be supplied from an oil control valve 100, to be described later, to the control oil chamber 42 through the control oil path 111 and the opening 14. A spring 15 that applies an urging force to the protruding part 72 in a direction of reducing the volume of the control oil chamber 42 is provided inside the housing space 40. The spring 15 is disposed on the opposite side of the protruding part 72 from the control oil chamber 42. When the oil is supplied to the control oil chamber 42 and the pressure inside the control oil chamber 42 becomes high, the adjusting ring 70 shifts in a direction of increasing the volume of the control oil chamber 42 against the urging force of the spring 15. Specifically, the adjusting ring 70 shifts while turning in the direction from the state shown in FIG. 1 to the state shown in FIG. 2 (in the counterclockwise direction in FIG. 1). Conversely, when the oil is discharged from the control oil chamber 42 and the pressure inside the control oil chamber 42 becomes low, the adjusting ring 70 shifts in the direction of reducing the volume of the control oil chamber 42 under the urging force of the spring 15. Specifically, the adjusting ring 70 shifts while turning in the direction from the state shown in FIG. 2 to the state shown in FIG. 1 (in the clockwise direction in FIG. 2). Thus, the position of the adjusting ring 70 depends on the pressure inside the control oil chamber 42 and the urging force of the spring 15. As the position of the adjusting ring 70 changes, the position of the meshing part of the teeth 51, 61 of the inner rotor 50 and the outer rotor 60 relative to each opening of the suction port 12 and the discharge port 13 changes. In this way, the amount of oil discharged from the discharge port 13 per rotation of the input shaft 11 is changed as the position of the adjusting ring 70 is changed through adjustment of the pressure inside the control oil chamber 42.

More specifically, when the pressure inside the control oil chamber 42 becomes high from the state in which the oil discharge amount is maximum as shown in FIG. 1, the adjusting ring 70 shifts while turning in the counterclockwise direction in FIG. 1 against the urging force of the spring 15 as the pressure rises. As a result, the area of overlap between the discharge port 13 and the part in which the clearance between the external teeth 51 of the inner rotor 50 and the internal teeth 61 of the outer rotor 60 decreases gradually as the rotors 50, 60 rotate becomes smaller, so that the amount of oil discharged from the discharge port 13 decreases. The adjusting ring 70 eventually shifts to a position at which the oil discharge amount is minimum as shown in FIG. 2. Conversely, when the pressure inside the control oil chamber 42 becomes low, the adjusting ring 70 shifts while turning in the clockwise direction in FIG, 2 under the urging force of the spring 15 as the pressure decreases, so that the amount of oil discharged from the discharge port 13 decreases.

The oil control valve 100 can switch the communication state of a plurality of oil paths by switching the position of the spool by an electromagnetic solenoid. Specifically, the oil control valve 100 includes a control port 101 to which the control oil path 111 is connected, a supply port 102 to which an oil supply path 112 branched from the oil discharge path 13*a* of the variable displacement oil pump 10 is connected, and a drain port 103 to which an oil drain path 113 through which oil is drained is connected. As the position of the spool is changed through control of a current flowing through the electromagnetic solenoid, the position of the spool is switched between a drain position (FIG. 1) at which the oil returning to the control port 101 is drained from the drain port 103 and a supply position (FIG. 2) at which the oil supplied to the supply port 102 is sent from the control port 101 to the control oil path 111.

Next, a fixation structure of the guide pins 81. 82 and the shapes of the long holes 711, 712 in which the guide pins 81, 82 are inserted will be described with reference to FIG. 3. FIG. 3 shows a state in which the guide pin 81 is inserted in the long hole 711. As the fixation structure of the guide pin 81 and the fixation structure of the guide pin 82 are the same, the fixation structure of the guide pins 81, 82 will be described with reference to FIG. 3 while the state in which the guide pin 82 is inserted in the long hole 712 will not be illustrated.

As shown in FIG. 3, the housing 20 is provided with a first hole 21 in which one end of the guide pin 81 (82) is press-fitted. The cover member 30 is provided with a second hole 31 as a housing hole in which the other end of the guide pin 81 (82) is loosely fitted (housed). In other words, the one end of the guide pin press-fitted in the first hole 21 is a fixed end 80*a* and the other end of the guide pin loosely fitted in the second hole 31 is a free end 80*b*. Thus, the housing 20 in this embodiment is one example of the first member to which the guide pins 81, 82 are fixed, and the cover member 30 is one example of the second member that is the other member and not the first member, In this embodiment, the free ends 80*b* of the guide pins 81, 82 are housed in the second holes 31 but not in contact with wall surfaces of the second holes 31. In other words, the free ends 80*b* of the guide pins 81, 82 are not in contact with the cover member 30.

As shown in FIG. 3, when the direction (left-right direction in FIG. 3) orthogonal to both the lengthwise direction of the guide pins 81, 82 (upper-lower direction in FIG. 3) and the extension direction of the long holes 711, 712 is defined as a specified direction X and the dimension of the long hole 711, 712 in the specified direction X is defined as the width of the long holes 711, 712, the width of the long holes 711, 712 is larger at a part of the long hole farther away from the fixed end 80*a* in the lengthwise direction of the guide pins 81, 82 than at a part thereof closer to the fixed end 80*a*. Specifically, the width of the long holes 711, 712 increases gradually as the long hole extends farther away from the fixed end 80*a* in the lengthwise direction of the guide pins 81. 82. When the dimension of the second hole 31 in the specified direction X is defined as a width HA of the second hole 31, a width HB1 of the long holes 711, 712 at the end on the side of the second hole 31 (the upper end in FIG. 3) is larger than the width HA of the second hole 31. A width HB2 of the long holes 711, 712 at the end on the side of the first hole 21 (the lower end in FIG. 3) is smaller than the width HA of the second hole 31.

The width HB2 of the long holes 711, 712 at the end on the side of the first hole 21 is slightly larger than the diameter of the guide pins 81, 82. Thus, some displacement of the adjusting ring 70 in the specified direction X is tolerated in this embodiment.

When those surfaces of wall surfaces 71A of the long holes 711, 712 that are located on both sides across the guide pins 81, 82 in the specified direction X are defined as guide surfaces 71B, both guide surfaces 71B are inclined surfaces that are inclined so as to be gradually separated from the guide pins 81, 82 in the specified direction X as the guide surfaces extend farther away from the fixed end 80*a* in the lengthwise direction of the guide pins 81, 82. Thus, when seen in the section shown in FIG. 3, the peripheral edge of the opening formed in the surface (the upper surface in FIG. 3) of the adjusting ring 70 on the side of the cover member 30 by the long hole 711 (712) provided in the adjusting ring 70 is located farther on the outside than the peripheral edge of the opening formed in the cover member 30 by the second hole 31 provided in the cover member 30.

Next, workings of the variable displacement oil pump 10 of this embodiment will be described along with effects thereof with reference to FIG. 4. When the variable displacement oil pump 10 mounted in an internal combustion engine receives heat from the internal combustion engine, heat is conducted from the housing 20 to the guide pins 81, 82 fixed to the housing 20. In the course of thus receiving heat repeatedly, the guide pins 81, 82 deform gradually at root parts that protrude from the housing 20 toward the cover member 30, and the guide pins 81, 82 may eventually incline so that the fixed end 80*a* and the free end 80*b* are misaligned in the specified direction X as shown in FIG. 4.

Figure 4:
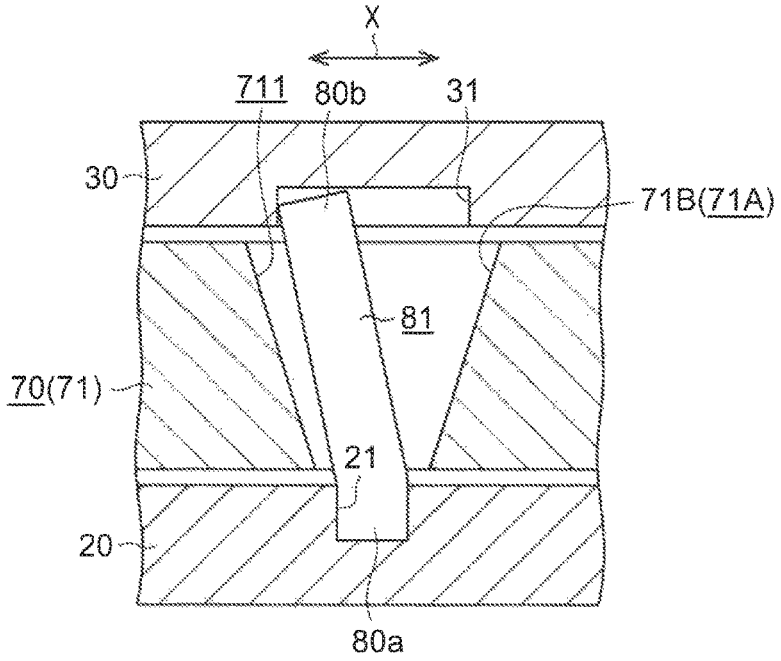
FIG. 4 is a sectional view showing a state in which a guide pin is inclined due to thermal deformation in the variable displacement oil pump of the embodiment.

As the guide pins 81, 82 thus incline inside the long holes 711, 712, the guide pins 81, 82 approach the guide surfaces 71B (in the example shown in FIG. 4, the guide surface on the left side of the guide pin 81 (82)) of the long holes 711, 712. In this embodiment, however, the guide surfaces 71B are inclined as shown in FIG. 4. Accordingly, even when the guide pins 81, 82 incline as shown in FIG. 4, the guide pins 81, 82 are less likely to come in contact with the guide surfaces 71B. Moreover, when the degree of inclination of the guide pins 81, 82 increases, the free ends 80*b* of the guide pins 81, 82 come in contact with the outermost ends of the wall surfaces of the second holes 31 in the specified direction.

Here, the free ends 80*b* of the guide pins 81, 82 shift only within the second holes 31. Moreover, the width HB1 of the long holes 711, 712 at the end on the side of the second hole 31 is larger than the width HA of the second hole 31.

Thus, when the guide pins 81, 82 incline so as to approach the guide surfaces 71B and the free ends 80*b* of the guide pins 81, 82 come in contact with the wall surfaces of the second holes 31, further inclination of the guide pins 81, 82 is prevented, so that contact between the guide pins 81, 82 and the guide surfaces 71B is prevented. Accordingly, the adjusting ring 70 is prevented from being pushed by the guide pins 81, 82 inclined in the specified direction X, and the clearances provided between the components such as the adjusting ring 70, the outer rotor 60, and the inner rotor 50 to allow smooth motion of these components is prevented from being narrowed. As a result, the adjusting ring 70 has no difficulty in shifting in the extension direction of the long holes 711, 712, and thus degradation of the controllability of the amount of oil discharged from the discharge port 13 can be prevented.

According to this embodiment, the following effects can he further achieved. (1) If a step is formed on the guide surfaces 71B of the long holes 711, 712, a shift of the adjusting ring 70 in the extension direction of the long holes 711, 712 in a state where the inclined guide pins 81, 82 are in contact with the step may result in local wear of the guide pins 81, 82. In this respect, since no step is formed on the guide surfaces 71B in this embodiment, local wear of the guide pins 81, 82 resulting from a shift of the adjusting ring 70 in a state where the guide pins 81, 82 are in contact with a step on the guide surface 71B can be prevented.

(2) In this embodiment, the guide surfaces 71B located on both sides of the guide pins 81, 82 in the specified direction X are inclined surfaces. Thus, to whichever side in the specified direction X the guide pins 81, 82 may incline, contact between the guide pins 81, 82 and the guide surfaces 71B can be prevented.

(3) In this embodiment, the width HB2 of the long holes 711, 712 at the end on the side of the first hole 21 is smaller than the width HA of the second hole 31. Thus, an excessive displacement of the adjusting ring 70 in the specified direction X can be prevented.

(4) When the variable displacement oil pump 10 is in operation, there is a part where the external teeth 51 of the inner rotor 50 and the internal teeth 61 of the outer rotor 60 mesh with each other, and a non-contact part that is a part where the external teeth 51 of the inner rotor 50 and the internal teeth 61 of the outer rotor 60 are not in contact with each other. However, if the guide pins 81, 82 inclined due to thermal deformation come in contact with the guide surfaces 71B of the long holes 711, 712 and the adjusting ring 70 is displaced in the specified direction X, the outer rotor 60 supported by the adjusting ring 70 is displaced along with the adjusting ring 70. Meanwhile, the positional relation between the inner rotor 50 and the outer rotor 60 changes. As a result, the tips of the external teeth 51 of the inner rotor 50 and the tips of the internal teeth 61 of the outer rotor 60 hit against each other in the non-contact part, and noise due to the hitting occurs. In this respect, even when the guide pins 81, 82 incline so as to approach the guide surfaces 71B of the long holes 711, 712, the guide pins 81, 82 are less likely to come in contact with the guide surfaces 71B in this embodiment. Accordingly, the adjusting ring 70 is less likely to be displaced in the specified direction X. Thus, changes in positional relation between the inner rotor 50 and the outer rotor 60 are prevented, so that noise due to the tips of the external teeth 51 of the inner rotor 50 and the tips of the internal teeth 61 of the outer rotor 60 hitting against each other can be prevented.

(5) Since the adjusting ring 70 is a sintered member, the manufacturing of the adjusting ring 70 involves removing the sintered adjusting ring 70 from a mold. The adjusting ring 70 is removed from the mold by moving the mold relative to the adjusting ring 70 in the penetration direction of the long holes 711, 712 (upper-lower direction in FIG. 3), i.e., in the upward direction in FIG. 3 in which the passage sectional area of the long holes 711, 712 increases gradually. To thus remove the adjusting ring 70 from the mold, contact between the mold and the guide surfaces 71B that are inclined surfaces can be eliminated early on by moving the mold in the upward direction in FIG. 3 relative to the adjusting ring 70. Thus, the gradient of the guide surfaces 71B can be used to remove the adjusting ring 70 from the mold. Accordingly, the adjusting ring 70 is easy to remove from the mold during manufacturing.

The above embodiment may be modified into other embodiments as follows. The guide surface 71B may have another shape that is not an inclined surface, as long as the guide surface 71B is shaped so as to be gradually separated from the guide pins 81, 82 as the guide surface 71B extends farther away from the fixed end 80*a* in the lengthwise direction of the guide pins 81, 82. For example, the guide surface 71B may be shaped so that the inclination gradient thereof changes gradually as the guide surface 71B extends away from the fixed end 80*a* in the lengthwise direction of the guide pins 81, 82, i.e., the guide surface 71B may be a curved surface. Effects similar to those of the above embodiment can be achieved with this configuration. However, it is not absolutely necessary that the inclination gradient changes gradually as the guide surface 71B extends away from the fixed end 80*a* in the lengthwise direction of the guide pins 81, 82. That is, the guide surface 71B may be a wavy uneven surface, as long as the guide surface 71B is shaped so as to be gradually separated from the guide pins 81, 82 as the guide surface 71B extends away from the fixed end 80*a* in the lengthwise direction of the guide pins 81, 82.

Figure 5:
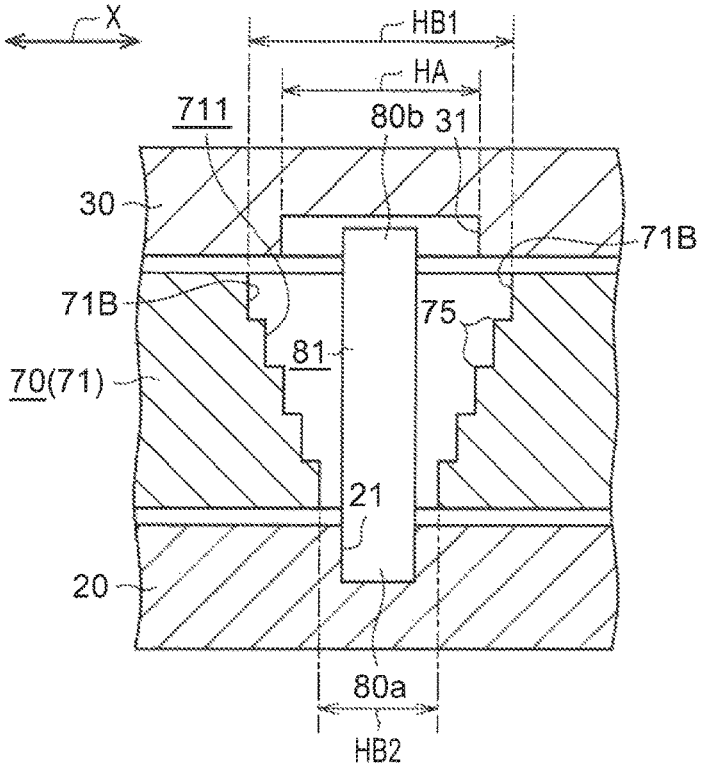
FIG. 5 is a sectional view illustrating the shapes of guide surfaces of a long hole in a variable displacement oil pump of another embodiment.

The guide surfaces 71B may have steps 75 as shown in FIG. 5, for example, as long as the guide surfaces 71B are each shaped so as to be separated farther away from the guide pins 81, 82 in the specified direction X at a part of the guide surface farther away from the fixed end 80*a* of the guide pins 81, 82 in the lengthwise direction of the guide pins 81, 82 than at a part thereof closer to the fixed end 80*a*. In this case, too, contact between the guide pins 81, 82 and the guide surfaces 71B of the long holes 711, 712 can be prevented even when the guide pins 81, 82 incline in the specified direction X.

As long as the width of the long holes 711, 712 is larger at a part of the long hole farther away from the fixed end 80*a* in the lengthwise direction of the guide pins 81, 82 than at a part thereof closer to the fixed end 80*a*, one of the guide surfaces may have a shape with the steps 75 as shown in FIG. 5 and the other guide surface may be a vertical surface. With this configuration, too, contact between the one guide surface and the guide pins 81, 82 can he prevented even when the guide pins 81, 82 incline in the direction of approaching the one guide surface with the steps 75.

As long as the width of the long holes 711, 712 is larger at a part of the long hole farther away from the fixed end 80*a* in the lengthwise direction of the guide pins 81, 82 than at a part thereof closer to the fixed end 80*a*, the width HB1 of the long holes 711, 712 at the end on the side of the second hole 31 may be equal to the width HA of the second hole 31. With this configuration, too, contact between the guide pins 81, 82 and the guide surfaces 71B of the long holes 711, 712 can be prevented even when the guide pins 81, 82 incline in the specified direction X.

Alternatively, the width HB1 of the long holes 711, 712 at the end on the side of the second hole 31 may be smaller than the width HA of the second hole 31. In this case, too, contact between the guide pins 81, 82 and the guide surfaces 71B of the long holes 711, 712 can be prevented even when the guide pins 81, 82 incline in the specified direction X.

As long as the width of the long holes 711, 712 is larger at a part of the long hole farther away from the fixed end 80*a* in the lengthwise direction of the guide pins 81, 82 than at a part thereof closer to the fixed end 80*a*, the width HB2 of the long holes 711, 712 at the end on the side of the first hole 21 may be equal to the width HA of the second hole 31 or may be larger than the width HA of the second hole 31. However, if the width HB2 at the end on the side of the first hole 21 is too large, the original function of the long holes 711, 712 to regulate the position of the adjusting ring 70 in the specified direction X is hindered. Thus, it is preferable that the width HB2 at the end on the side of the first hole 21 is not too large.

Figure 6:
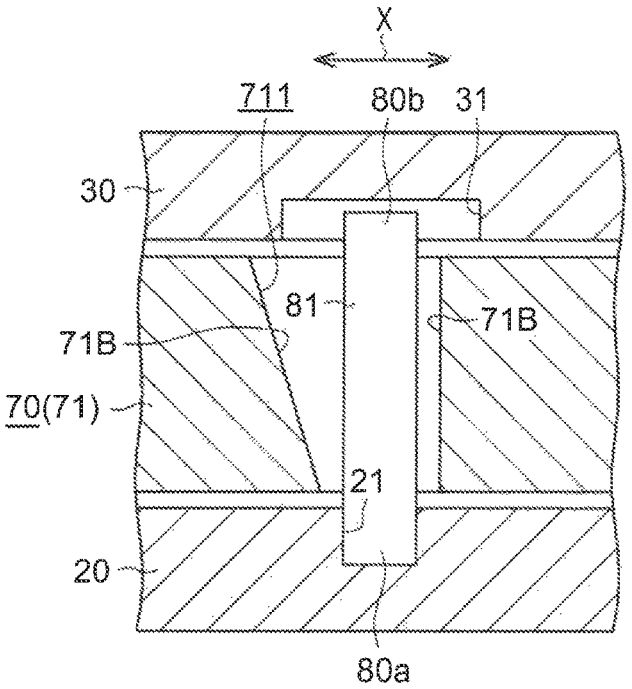
FIG. 6 is a sectional view illustrating the shapes of guide surfaces of a long hole in a variable displacement oil pump of yet another embodiment.

In the above embodiment, the guide surfaces 71B located on both sides across the guide pins 81, 82 in the specified direction X are inclined surfaces. However, only one of the guide surfaces 71B may be an inclined surface. For example, as shown in FIG, 6, the guide surface 71B on the left side in FIG. 6 (i.e., the side farther away from the rotors 50, 60) of the two guide surfaces 71B may be an inclined surface, while the other guide surface 71B on the right side in FIG. 6 (i.e., the side closer to the rotors 50, 60) may be a vertical surface. In this case, as shown in FIG. 6, it is preferable that the end on the side of the cover member 30 (the upper end in FIG. 6) of the guide surface 71B (inclined surface) on the left side in FIG. 6 is disposed farther on the outside in the radial direction centered at the shaft center of the guide pins 81, 82 than the peripheral edge of the opening formed in the cover member 30 by the second hole 31 provided in the cover member 30. With this configuration, too, contact between the guide surfaces 71B and the guide pins 81, 82 can be prevented even when the guide pins 81, 82 incline in the direction of approaching the guide surface 71B on the left side in FIG. 6.

Conversely, the guide surface 71B closer to the rotors 50, 60 of the two guide surfaces 71B may be an inclined surface, and the guide surface 71B farther away from the rotors 50, 60 may be a vertical surface. With this configuration, too, contact between the guide surfaces 71B and the guide pins 81, 82 can be prevented even when the guide pins 81, 82 incline toward the guide surface 71B closer to the rotors 50, 60.

In the above embodiment, the guide pins 81, 82 are fixed to the housing 20 by press-fitting the one ends of the guide pins 81, 82 into the first holes 21. However, another method (e.g., deposition or welding) may be used to fix the guide pins 81, 82 to the housing 20.

The guide pins 81, 82 may be fixed to the cover member 30. For example, one ends of the guide pins 81, 82 may be press-fitted into the second holes 31 of the cover member 30, and the other ends of the guide pins 81, 82 may be loosely fitted into the first holes 21 of the housing 20. In this case, the cover member 30 is one example of the first member, and the housing 20 is one example of the second member. If the guide pins 81, 82 are fixed to the cover member 30, the width of the long holes 711, 712 should be larger at a part of the long hole farther away from the cover member 30 in the lengthwise direction of the guide pins 81, 82 than at a part thereof closer to the cover member 30. Thus, effects similar to those of the above embodiment can be achieved.

If the guide pins 81, 82 are fixed to the first member that is one of the housing 20 and the cover member 30, pins with such a shape that the leading end the end on the second member side) does not reach the second member may be used as the guide pins 81, 82.

The inner rotor 50, the outer rotor 60, and the adjusting ring 70 may he members manufactured by a method other than sintering. In the above embodiment, the variable displacement oil pump is embodied as a trochoid pump with the inner rotor 50 and the outer rotor 60. However, the variable displacement oil pump of the present disclosure may be embodied as a variable displacement oil pump other than trochoid pumps, as long as the pump can change the amount of oil discharged from its discharge port by shifting a shiftable member. One example of such variable displacement oil pumps is a vane pump.

What is claimed is:

1. A variable displacement oil pump comprising:

a housing;

a cover, the housing and the cover defining a housing space;

an adjustable member configured to shift inside the housing space, the adjustable member having a long hole, and the adjustable member defining a control oil chamber inside the housing space; and a guide pin fixed to either one of the housing and the cover, the guide pin being disposed inside the long hole, wherein the adjustable member is configured to shift in an extension direction of the long hole according to changes in pressure inside the control oil chamber such that an amount of oil discharged from a discharge port of the variable displacement oil pump changes, a width of the long hole at a part of the long hole farther away from a fixed end of the guide pin, in a lengthwise direction of the guide pin, is larger than a width at a part of the long hole closer to the fixed end, the width of the long hole is defined by a dimension of the long hole in a specified direction, the specified direction is a direction orthogonal to both the lengthwise direction of the guide pin and the extension direction of the long hole, the adjustable member is configured to be movable relative to the guide pin in the specified direction, and the other one of the housing and the cover to which the guide pin is not fixed has a hole that is configured to receive the free end of the guide pin and limit the relative movement between the guide pin and the adjustable member in the specified direction.

2. The variable displacement oil pump according to claim 1, wherein the guide pin is fixed to a first member, the first member is one of the housing and the cover, the other one of the housing and the cover that is not the first member is a second member, the second member has a housing hole in which a free end of the guide pin is housed, and the width of the long hole at the end of the long hole on a housing hole side is larger than a width of the housing hole, the width of the housing hole is a dimension of the housing hole in the specified direction.

3. The variable displacement oil pump according to claim 1, wherein the width of the long hole increases gradually as the long hole extends farther away from the fixed end of the guide pin in the lengthwise direction of the guide pin.

4. The variable displacement oil pump according to claim 1, wherein surfaces of wall surfaces of the long hole of the adjustable member that are located on both sides across the guide pin in the specified direction are guide surfaces, and the guide surfaces of the long hole are each shaped so as to be separated farther away from the guide pin in the specified direction at a part of the guide surface farther away from the fixed end of the guide pin in the lengthwise direction of the guide pin than at a part of the guide pin closer to the fixed end.

5. The variable displacement oil pump according to claim 4, wherein the guide surfaces of the long hole are each shaped so as to be separated farther away from the guide pin in the specified direction as the guide surface extends farther away from the fixed end of the guide pin in the lengthwise direction of the guide pin.

* * * * *